US006196747B1

(12) United States Patent
Kreiseder et al.

(10) Patent No.: US 6,196,747 B1
(45) Date of Patent: Mar. 6, 2001

(54) PRODUCT DISPENSING COVER

(75) Inventors: Walter J. Kreiseder, Barrington; John A. Sekowski, Long Grove; William C. Schmeisser, Barrington, all of IL (US)

(73) Assignee: Creative Packaging Corp., Buffalo Grove, IL (US)

( * ) Notice: Subject to any disclaimer, the term of this patent is extended or adjusted under 35 U.S.C. 154(b) by 635 days.

(21) Appl. No.: 08/576,618

(22) Filed: Dec. 21, 1995

(51) Int. Cl.[7] ..... B05C 11/00
(52) U.S. Cl. ..... 401/266; 401/148
(58) Field of Search ..... 401/266, 148

(56) References Cited

U.S. PATENT DOCUMENTS

| | | | | |
|---|---|---|---|---|
| 1,017,957 | * | 2/1912 | Clark | 401/26 X |
| 2,917,765 | * | 12/1959 | Jakubowski | 401/266 X |
| 2,949,621 | * | 8/1960 | Clement et al. | 401/148 |
| 2,949,622 | * | 8/1960 | Clement | 401/148 |
| 3,088,636 | | 5/1963 | Spatz . | |
| 3,220,044 | * | 11/1965 | Smalley | 401/148 |
| 4,184,603 | | 1/1980 | Hamilton, Sr. . | |
| 4,230,240 | | 10/1980 | Laauwe . | |
| 4,623,337 | | 11/1986 | Maurice . | |
| 4,681,524 | | 7/1987 | Ikeda et al. . | |
| 4,865,231 | | 9/1989 | Wiercinski . | |
| 5,000,356 | | 3/1991 | Johnson et al. . | |
| 5,007,755 | | 4/1991 | Thompson . | |
| 5,073,057 | | 12/1991 | Lathrop et al. . | |
| 5,454,660 | | 10/1995 | Sakurai et al. . | |

FOREIGN PATENT DOCUMENTS

| | | | | |
|---|---|---|---|---|
| 249473 | | 10/1962 | (AU) . | |
| 100204 | * | 2/1984 | (EP) | 401/266 |
| 1441112 | | 8/1966 | (FR) . | |
| 2573734 | | 5/1986 | (FR) . | |

* cited by examiner

*Primary Examiner*—David J. Walczak
(74) *Attorney, Agent, or Firm*—Silverman, Cass & Singer, Ltd.

(57) ABSTRACT

A dispensing cover for a cream or gel product contained in a sleeve with an elevator platform for advancing the product toward the cover. The cover includes a dome portion having at least one passageway to permit the product to pass through the cover for dispensing. A weakened area about the periphery of the cover permits the dome portion to flex downwardly into contact with the product when a force is exerted against the cover, and to return to its original unflexed position with an air gap between the dome part and the product when the force is removed from the cover.

13 Claims, 4 Drawing Sheets

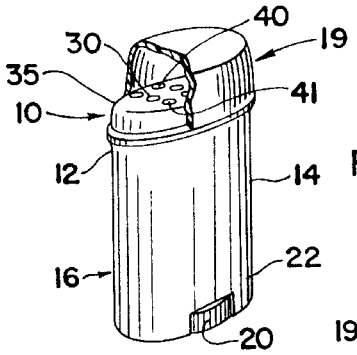
FIG. 1
FIG. 2
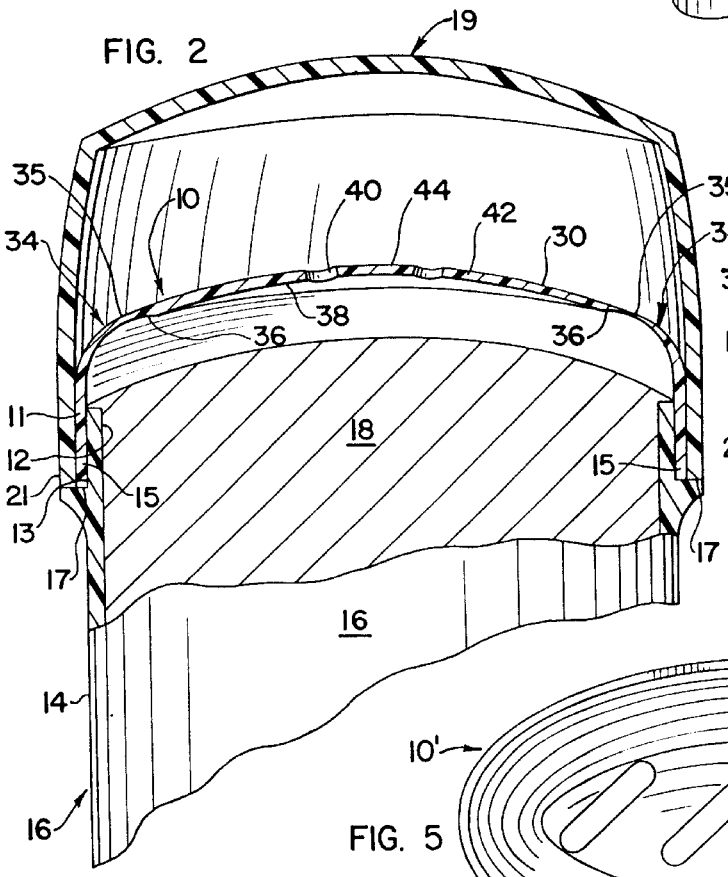
FIG. 3
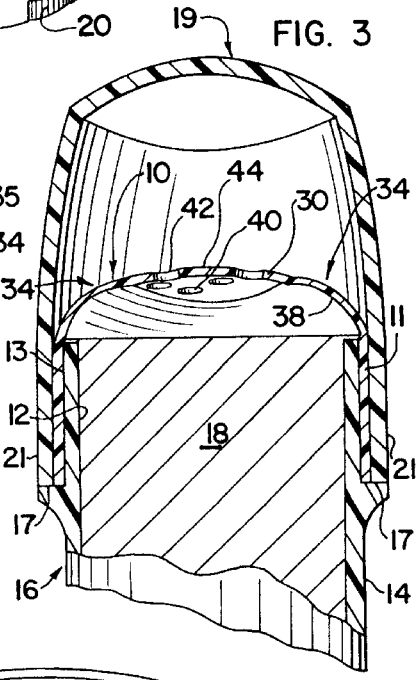
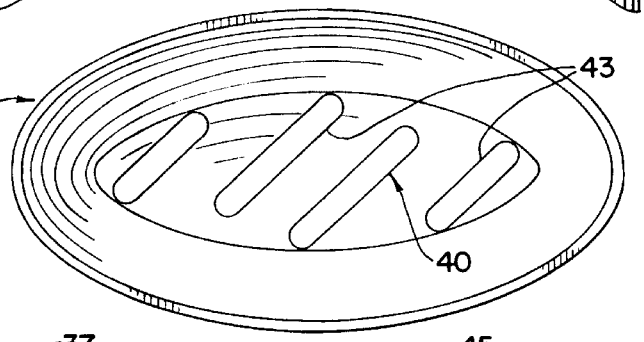
FIG. 5
FIG. 4
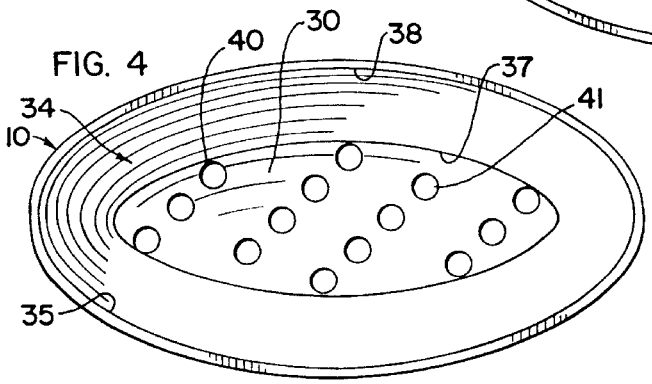
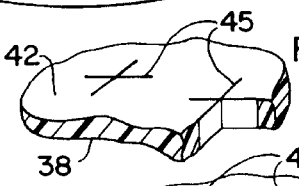
FIG. 6
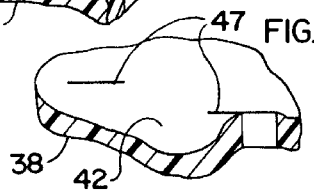
FIG. 7

FIG. 11
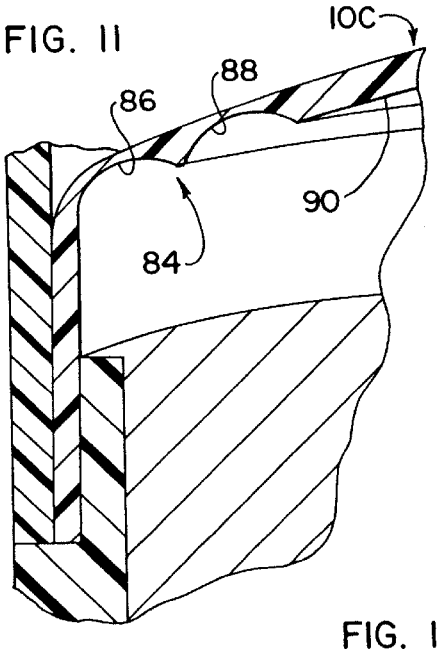
FIG. 12
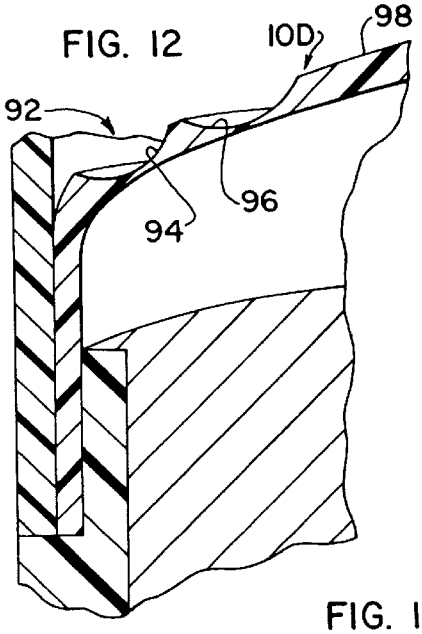
FIG. 13
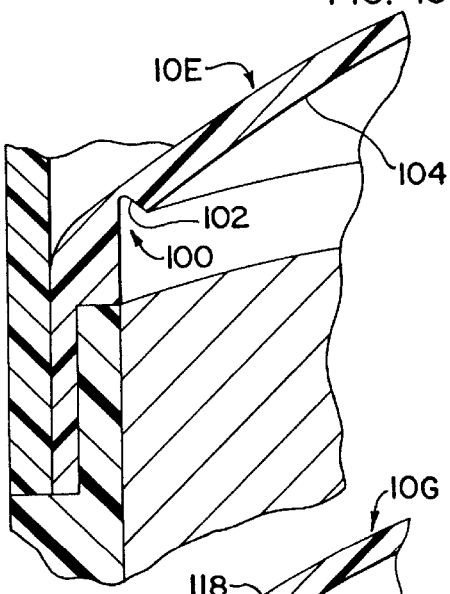
FIG. 14
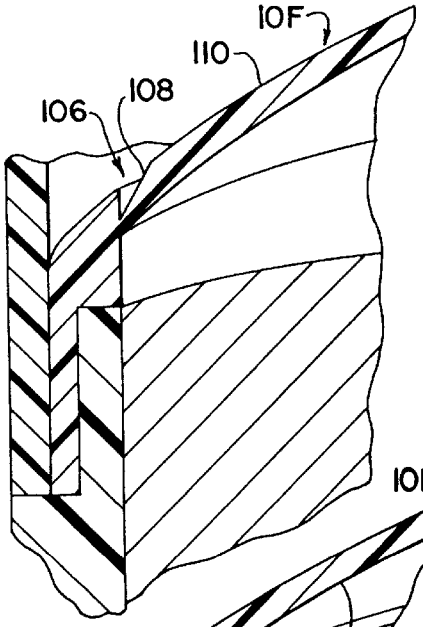
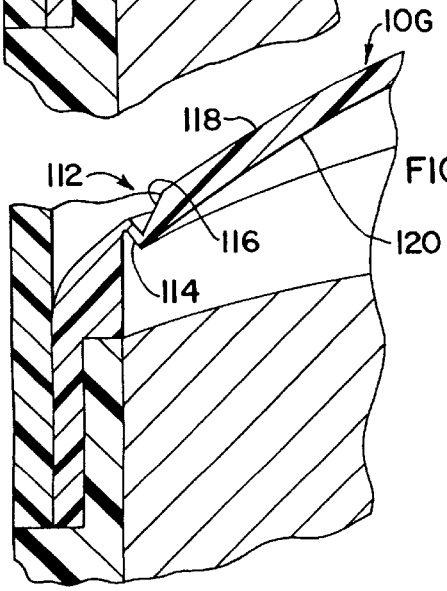
FIG. 15
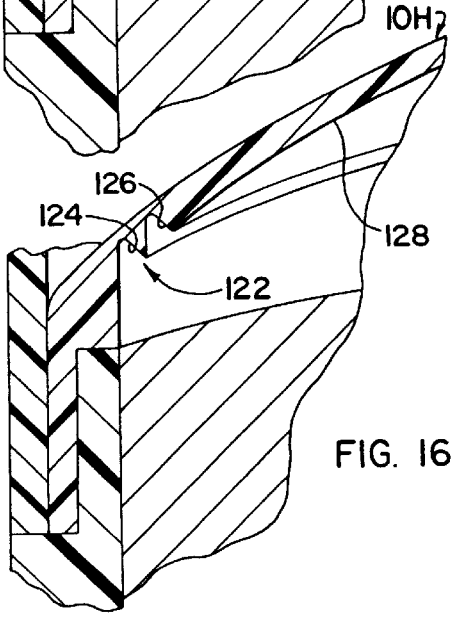
FIG. 16

PRODUCT DISPENSING COVER

BACKGROUND OF THE INVENTION

1. Field of the Invention

This invention relates generally to product dispensers, and more particularly, to a dispensing cover for dispenser for a cream or gel deodorant product in which the product is advanced within a sleeve to such a dispensing cover.

2. Description of Related Art

Dispensers including a generally cylindrical sleeve and product advancing means are known for dispensing cream or gel products contained within the sleeve. Such dispensers commonly are used for deodorant products which are advanced within the sleeve by movement of an elevator platform or the like so that the product is presented at a dispensing end of the sleeve.

Certain of such dispensers are provided with a dispensing cover positioned over the dispensing end of the sleeve containing the product. The dispensing cover is provided with one or more passageways through which the cream or gel product is extruded as the elevator platform is advanced. The product thereby is presented to the external surface of the cover to be dispensed as intended, such as to the skin of a user of the deodorant product.

An undesirable side effect of dispensing cream or gel product in such dispensers is that after the product has been dispensed, residual pressure against the product within the sleeve causes the product to continue to creep through the passageways and out to the external surface of the dispensing cover. This results in product waste and undesirable product remaining to be removed from the dispensing cover surface prior to storage of the dispenser.

Attempts have been made to prevent the undesirable waste of product due to creeping during use of dispensers of the type referred to herein. These attempts have involved dispensers incorporating springs, ratchet bars, oscillating feed screws and similar complicated structure which do not satisfactorily obviate the problem.

Accordingly, it is desirable to provide a dispenser for a cream or gel product which prevents undesirable waste of the product due to creeping thereof after dispensing is completed, which dispenser is relatively simple in design, uncomplicated in construction and which readily can be manufactured with a minimum number of parts and is sturdy in construction for repeated use without failure.

SUMMARY OF THE INVENTION

The invention provides a dispensing cover for a cream or gel product dispenser which includes a sleeve within which the product is contained. An elevator platform or the like is positioned within the sleeve at a location opposite the dispensing cover. The cover includes a dome portion having at least one passageway to permit the product to pass through the cover to the external surface thereof as the platform is advanced within the sleeve. The cover is formed with a depending skirt portion co-joined with the dome portion and a weakened area about the periphery of the dome portion proximate its joinder with the skirt portion to permit the dome portion to flex downwardly into contact with the product when a force is exerted against the external surface of the cover, and to return to its original unflexed position with an air gap between the dome part and the product when the force is removed from the cover.

BRIEF DESCRIPTION OF THE DRAWINGS

FIG. 1 is a perspective view of a dispenser with an overcap thereof partially broken away to show one embodiment of the dispensing cover of the invention;

FIG. 2 is a format elevational view, partially in longitudinal section, showing the dispenser of FIG. 1;

FIG. 3 is a side elevational view, partially in longitudinal section, showing the dispenser of FIG. 1;

FIG. 4 is a plan view of the underside of the dispensing cover shown in FIG. 1 in which the passageways are formed by apertures;

FIG. 5 is a plan view of the underside of an alternate embodiment of the dispensing cover of the invention in which the passageways are formed by slots;

FIG. 6 is a fragmentary view of another alternate embodiment of the dispensing cover of the invention in which the passageways are formed by cross slits;

FIG. 7 is a fragmentary view of a further alternate embodiment of the dispensing cover of the invention in which the passageways are formed by a single slit;

FIG. 11 is a view similar to that of FIG. 9 showing a further alternate embodiment of the dispensing cover of the invention;

FIG. 12 is a view similar to that of FIG. 9 showing a further alternate embodiment of the dispensing cover of the invention;

FIG. 13 is a view similar to that of FIG. 9 showing a further alternate embodiment of the dispensing cover of the invention;

FIG. 14 is a view similar to that of FIG. 9 showing a further alternate embodiment of the dispensing cover of the invention;

FIG. 15 is a view similar to that of FIG. 9 showing a further alternate embodiment of the dispensing cover of the invention;

FIG. 16 is a view similar to that of FIG. 9 showing a further alternate embodiment of the dispensing cover of the invention;

DESCRIPTION OF THE PREFERRED EMBODIMENTS

Figures 8, 9, 10:
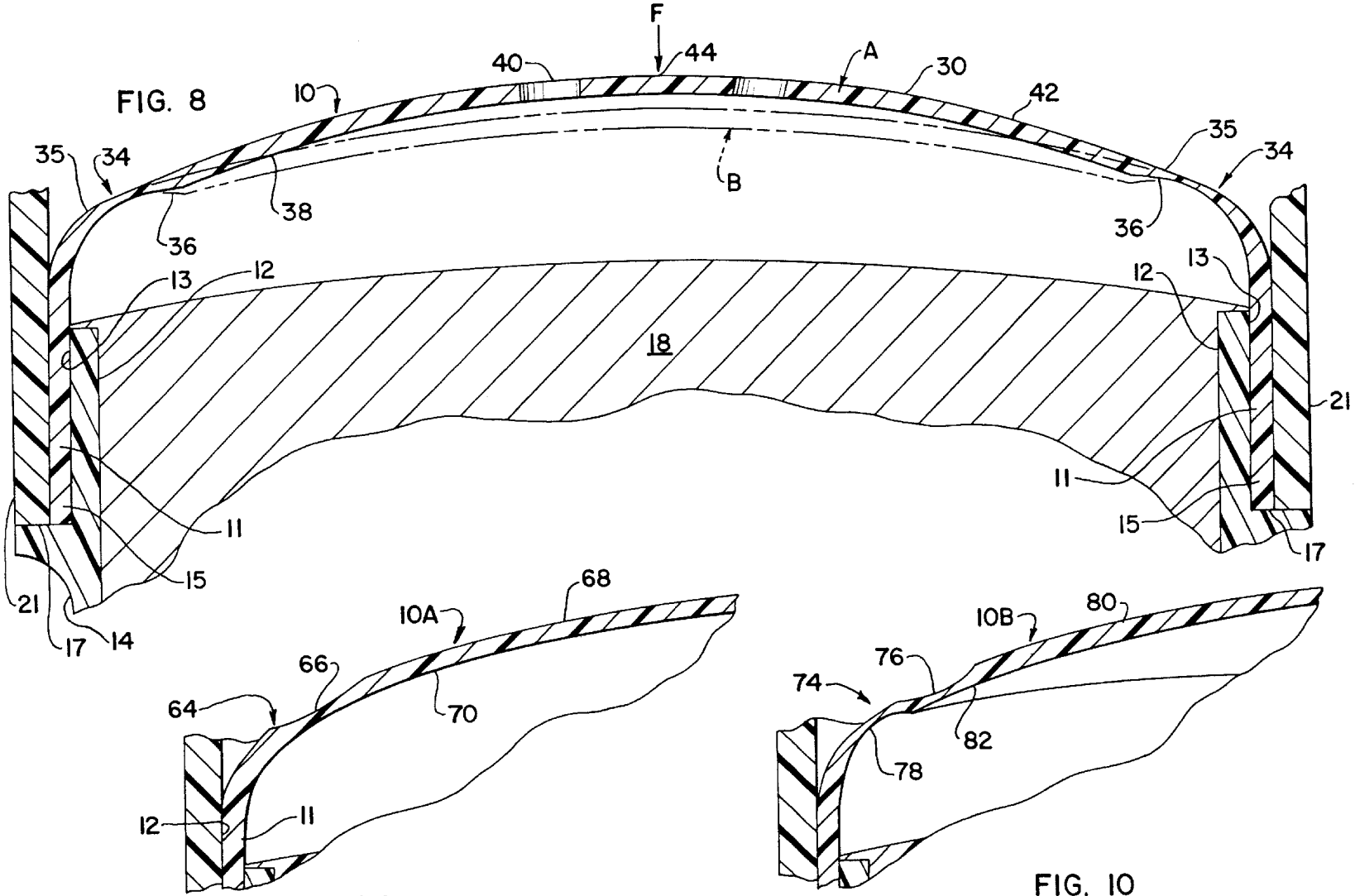
FIG. 8 is an enlarged fragmentary longitudinal sectional view showing the dispensing cover illustrated in FIG. 1 in each of its flexed and unflexed positions.
FIG. 9 is a fragmentary view similar to that of FIG. 8 showing an alternate embodiment of the dispensing cover of the invention.
FIG. 10 is a view similar to that of FIG. 9 showing a further alternate embodiment of the dispensing cover of the invention.

Referring to FIGS. 1–4, 8 and 17–22, the dispensing cover 10 of the invention is shown installed upon the upper dispensing end 12 of sleeve 14 of product dispenser 16. The manner of attachment of dispensing cover 10 to sleeve 14 can be by force-fit, adhesion or the like, of depending flange 11 of cover 10 over the external surface 13 of dispensing end 12 of sleeve 14. Terminal portions 15 of cover 10 can rest on ledge 17 formed on end 12 for positioning purposes. A removable overcap 19 may be provided to be positioned over cover 10 with terminal portions 21 resting on ledge 17 until the overcap is removed by the user of dispenser 16 prior to use.

A cream or gel product 18, such as (but not limited to) deodorant, is contained within sleeve 14 for dispensing by a user in conventional manner, such as by rotation of hand wheel 20 at the lower end 22 of the sleeve to rotate screw 24 and thereby raise connected elevator platform 26 and advance the product 18 toward dispensing end 12. It is to be understood that the structure for advancing product 18 within sleeve 14 toward dispensing end 12 does not form a part of the present invention, and that such advancement can be accomplished in any conventional manner, such as by the screw 24 and elevator platform 26 mechanism illustrated in the drawings.

Dispensing cover 10 preferably is formed of resilient material, such as plastic, and includes a dome portion 30 of generally outwardly-bowed configuration connected to depending skirt or flange 11 having terminal portions 15 which are installed upon dispensing end 12 of sleeve 14. The dome portion 30 is joined to skirt 11 by a weakened or thinned area 34 formed about the outer peripheral edge 35 of the dome portion 30. The thickness of the wall stock from which cover 10 is formed can vary. It is important only for purposes of the present invention that the thickness of weakened or thinned area 34 be less than at least some of the remaining portions of cover 10.

The weakened area 34 is provided by a thinned wall corner 36 which is formed on the underside surface 38 of cover 10 between outer peripheral edge 35 and a line 37 positioned inwardly and generally concentric to said edge 35. One or more passageways 40, such as apertures 41, are formed in dome portion 30 between the top surface 42 and underside surface 38 of the dome portion 30 to permit product 18 to pass therethrough when dispensing thereof is to be effected. The passageways 40 are arranged in the area of dome portion 30 between the central highest location 44 thereof and the line 37 defining the inner terminus of weakened area 34.

By reason of the weakened area 34 formed about the corner 36 of cover 10, dome portion 30 is capable of flexing between a first, relaxed or unflexed position A shown in solid line in FIG. 8, to a second, flexed position B shown in broken line in FIG. 8. Such flexing between positions A and B will occur when a force F is exerted against the top surface 42. Flexing of cover 10 as shown in FIG. 8 results in the dome portion moving toward product 18 contained within sleeve 14. Upon release of the force F against top surface 42, since cover 10 is formed of resilient material, dome portion 30 will return to its unflexed position A away from product 18.

Figure 17:
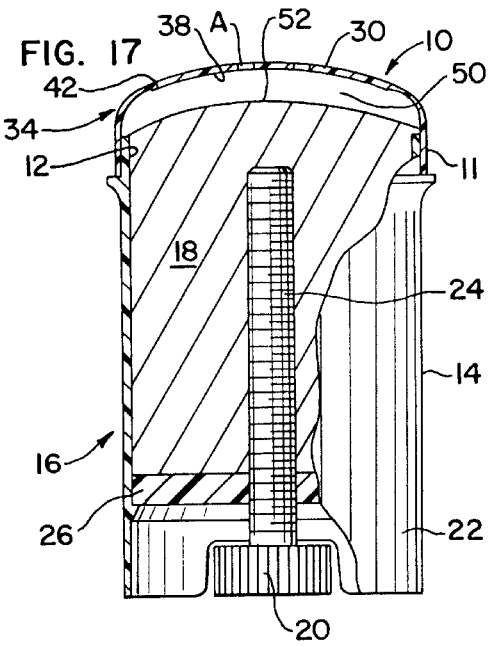
FIG. 17 is a longitudinal sectional view of a dispenser, with the sleeve thereof partially broken away, and the dispensing cover of the invention thereof showing a first stage of dispensing of the product contained therein.
Figure 18:
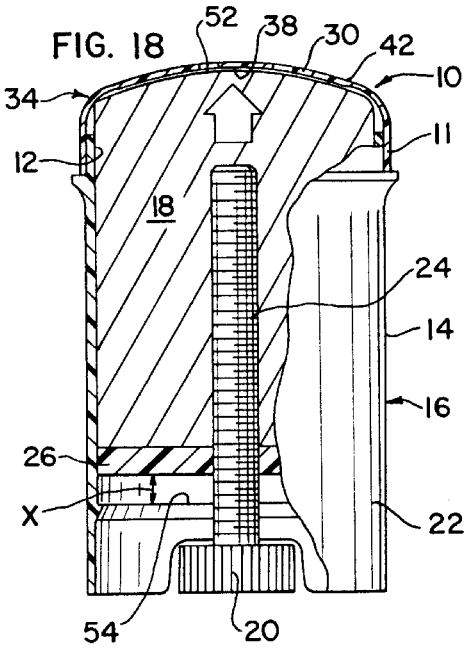
FIG. 18 is a view similar to that of FIG. 17 showing a subsequent stage of dispensing of the product.
Figure 19:
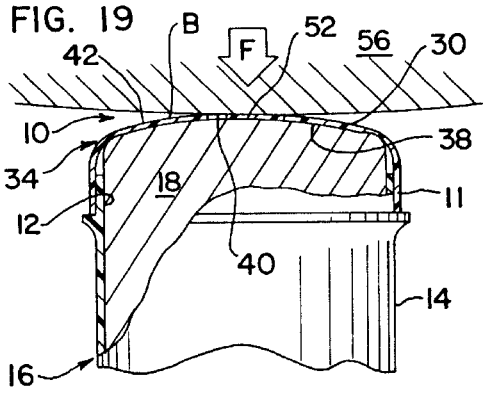
FIG. 19 is a view similar to that of FIG. 17, partially fragmented, showing a subsequent stage of dispensing of the product.

The flexing capability of cover 10 between positions A and B enables the dispenser 16 to be used without waste of product due to creeping within sleeve 14, as illustrated best in FIGS. 17–22. In FIG. 17, cover 10 is shown in its unflexed position A with product 18 contained in sleeve 14 and an air gap 50 between the underside surface 38 of dome portion 30 and the upper surface 52 of the product. A user will rotate screw 24 by turning hand wheel 20 to advance elevator platform 26 a distance "X" (FIG. 18) above the lower wall 54 of sleeve 14 and thereby move the upper surface 52 of product 18 to a position proximate underside surface 38 of dome portion 30. The size of the air gap 50 thereby is diminished from that shown in FIG. 17 to a smaller size as seen in FIG. 18.

Figure 20:
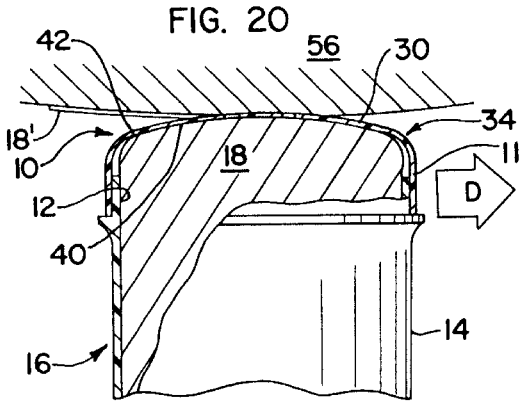
FIG. 20 is a view similar to that of FIG. 19 showing a subsequent stage of dispensing of the product.

The user next applies the top surface 42 of dome portion 30 to his or her skin surface 56 so that force F is exerted against the top surface 42 and thereby move dome portion 30 to its flexed position B in which there is no air gap between underside surface 38 of dome 30 and upper surface 52 of product 18, but instead the underside surface 38 engages against the upper surface 52 of product 18. Product 18 thereby is caused to pass through passageways 40 to be dispensed to the skin surface 56 of the user, and such dispensing is caused to be effected over a length of the user's skin by moving dispenser 16 along the skin surface as shown in FIG. 20 where a film of product 18' is illustrated on the user's skin after passing through passageways 40 and behind the direction D of movement of dispenser 16.

Upon completion of dispensing of product 18 by the user, the dome portion 30 is withdrawn from the user's skin surface 56. The force F thereby is relieved and the dome portion 30 relaxes to its unflexed position A as seen in FIG. 21, resulting in air gap 50 recurring between the underside surface 38 and the top surface 52 of product 18 so that product 18 does not continue to pass through passageways 40.

Figure 21:
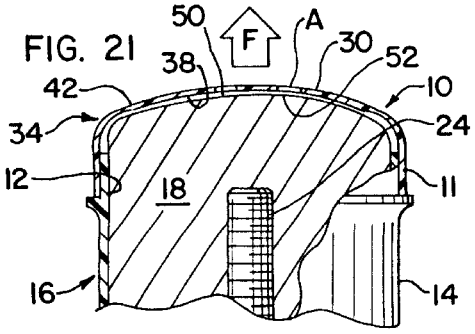
FIG. 21 is a view similar to that of FIG. 19 showing a subsequent stage of dispensing of the product.
Figure 22:
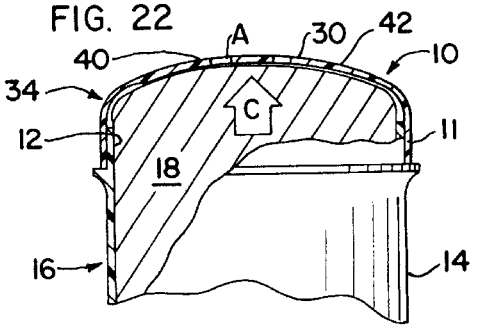
FIG. 22 is a view similar to that of FIG. 19 showing a subsequent stage of dispensing of the product.

As previously explained, residual pressure against product 18 within sleeve 14 after completion of dispensing as seen in FIG. 21 causes the product to continue to move or creep so that the top surface 52 of the product advances toward the underside surface 38 of the cover 10. However, by reason of the air gap 50 which occurs between surface 38 and surface 52 after dispensing and when cover 10 assumes its unflexed position A, such post-dispensing creeping C of the product merely fills the air gap, as seen in FIG. 22, and product does not continue to pass through passageways 40. Thereby, product waste is avoided and the top surface 42 of cover 10 remains clean without the necessity to remove excess product therefrom prior to storage of the dispenser in its condition shown in FIG. 22, which is preparatory to the next desired usage of dispenser 16.

While the preferred embodiment of the invention illustrates the passageways 40 in the form of apertures 41, variations are possible within the scope of the present invention. For example, the passageways 40 could be formed in the configuration of one or more slots 43, as illustrated on cover 10' in FIG. 5. Alternately, the passageways could be formed as one or more slits 45, 47 as shown in FIGS. 6 and 7. In FIG. 6, the slits 45 are formed in cross-like configuration, and in FIG. 7 the slits 47 are formed in single cut configuration. The passageways formed by slits 45, 47 permit product 18 to pass therethrough to the top surface 42 of cover 10 when the product is forced against the underside surface 38 which causes the area of the cover surrounding the slits to separate and open the slits. After dispensing of product 18 and relief of pressure by the product against the underside surface 38, the area of the cover surrounding the slits will return to its original position illustrated in FIGS. 6 and 7 in which the slits are again closed.

Although thinned wall weakened area 34 is illustrated in FIGS. 1–4, 8 and 17–22 as generally single scallop arc-like configuration on the underside surface 38 of cover 10, a wide range of variations are contemplated within the scope of the invention. For instance, the weakened area could be formed in single or multiple configurations, on the top or underside surface of the cover, or both surfaces. The area also can be formed in scallop, arc-like configurations, as notches, or as accordion pleats. The important feature is that the general area 34 proximate corner 36 of cover 10 be weakened to permit the desired flexing of the cover between positions A and B, as explained above. Representative alternate embodiments of such variant-formed weakened areas are illustrated in FIGS. 9–16 of the drawings, but these are intended to be illustrative only of the formations which can be employed and other variations are possible within the scope of the invention.

In FIG. 9, weakened area 64 is formed by a generally single scallop, arc-like portion 66 positioned on the top surface 68 of the cover 10A, rather than the underside surface 70 as illustrated on cover 10 in FIGS. 1–4.

In FIG. 10, weakened area 74 is formed by multiple generally scallop, arc-like portions 76, 78 positioned on the top surface 80 and on the underside surface 82 of cover 10B.

In FIG. 11, weakened area 84 is formed by multiple generally scallop, arc-like portions 86, 88 positioned on the underside surface 90 of cover 10C.

In FIG. 12, weakened area 92 is formed by multiple generally scallop, arc-like portions 94, 96 positioned on the top surface 98 of cover 10D.

In FIG. 13, weakened area 100 is formed by a generally V-shaped notch 102 positioned on the underside surface 104 of cover 10E.

In FIG. 14, weakened area 106 is formed by a generally V-shaped notch 108 positioned on the top surface 110 of cover 10F.

In FIG. 15, weakened area 112 is formed by multiple V-shaped notches 114, 116 in the general configuration of accordion pleats positioned on the top and underside surfaces 118, 120 of cover 10G.

In FIG. 16, weakened area 122 is formed by multiple V-shaped notches 124, 126 positioned on the underside surface 128 of cover 10H.

In each of the illustrated embodiments of FIGS. 9–16, as in the preferred embodiment of FIGS. 1–4, the weakened areas function to permit the cover to flex between positions A and B as described.

Modifications and variations of the present invention are possible in light of the above teachings. A specific dimension, material or construction is not required so long as the invention is capable of functioning as herein described. It is therefore to be understood that within the scope of the appended claims, the invention may be practiced otherwise than as specifically described.

What is claimed and desired to be secured by Letters Patent of the United States is:

1. A dispensing cover for a product dispenser, the dispenser including a sleeve in which the product is contained between a first end having product moving means to move the product within the sleeve and a second dispensing end toward which the product is moved by said product moving means, said cover comprising, a relatively thick dome portion with an external top surface and an internal underside surface, a depending skirt portion co-joined with the dome portion about a peripheral edge thereof, said cover being secured to the dispenser at the dispensing end thereof, at least one passageway provided in the dome portion to permit the product to pass through the cover to said external top surface, and a weakened relatively thin area formed in the cover about said peripheral edge acting as a peripheral hinge to permit the dome portion to flex into contact with the product when a force is exerted against said external top surface of the cover to express said product through said cover and to return to its original unflexed position out of contact with the product when the force is removed from said external top surface of the cover.

2. A dispensing cover as claimed in claim 1 in which an air gap is present between said underside surface and the product when the dome portion is returned to its original unflexed position upon removal of the force from said external top surface of the cover.

3. A dispensing cover as claimed in claim 1 including a plurality of passageways arrayed over the external top surface of said dome.

4. A dispensing cover as claimed in claim 1 in which said passageway is a slot.

5. A dispensing cover as claimed in claim 1 in which said passageway is a slit.

6. A dispensing cover as claimed in claim 1 in which said passageway is a pair of cross slits.

7. A dispensing cover as claimed in claim 1 in which said weakened area is formed by a thinned wall corner.

8. A dispensing cover as claimed in claim 7 in which said thinned wall corner is formed from stock which is of a thickness less than at least some of the remaining portions of said cover.

9. A dispensing cover as claimed in claim 7 in which the thinned wall corner is formed on said internal underside surface.

10. A dispensing cover as claimed in claim 7 in which said thinned wall corner is formed on said external top surface.

11. A dispensing cover as claimed in claim 1 in which said weakened area is formed by at least one generally scallop-shaped thinned wall portion of the cover.

12. A dispensing cover as claimed in claim 1 in which said weakened area is formed by at least one generally V-shaped notch formed in the cover.

13. A dispensing cover as claimed in claim 1 in which said weakened area is formed by multiple V-shaped notches in the general configuration of accordion pleats formed in the cover.

* * * * *